United States Patent [19]

Mars

[11] 4,089,045

[45] May 9, 1978

[54] PLASMA PANEL MOUNTING FRAME

[75] Inventor: James Robert Mars, Eden Prairie, Minn.

[73] Assignee: Control Data Corporation, Minneapolis, Minn.

[21] Appl. No.: 739,401

[22] Filed: Nov. 8, 1976

[51] Int. Cl.[2] ..... F21V 15/04

[52] U.S. Cl. ..... 362/390; 248/15; 313/269; 362/84

[58] Field of Search ..... 240/2.25, 52 R, 90; 313/49, 50, 269, 231.3, 231.4; 248/18, 15, 20–22, 358 R

[56] References Cited

U.S. PATENT DOCUMENTS

| | | | |
|---|---|---|---|
| 2,685,425 | 8/1954 | Wallerstein | 248/358 R |
| 2,778,629 | 1/1957 | Johnson | 248/18 X |
| 3,115,323 | 12/1963 | Crandell | 248/20 |
| 3,185,428 | 5/1965 | Farabaugh et al. | 248/358 R |
| 3,692,264 | 9/1972 | Burkhard et al. | 248/358 R |
| 3,828,215 | 8/1974 | Bilsback | 313/50 |

*Primary Examiner*—Richard L. Moses
*Attorney, Agent, or Firm*—Edward L. Schwarz

[57] ABSTRACT

A structure for supporting a particular type of plasma display panel. The panel is of the type formed of two flat rectangular plates attached to each other face to face with crossed longitudinal axes, the active panel area comprising the face to face surfaces. Support bars with resilient gaskets interposed between themselves and the two plates provide a shock-resistant mounting. Electronic circuitry can be attached to the support bars to provide a compact package with electronic circuitry adjacent to and substantially coplanar with the panel itself.

12 Claims, 5 Drawing Figures

FIG. 1
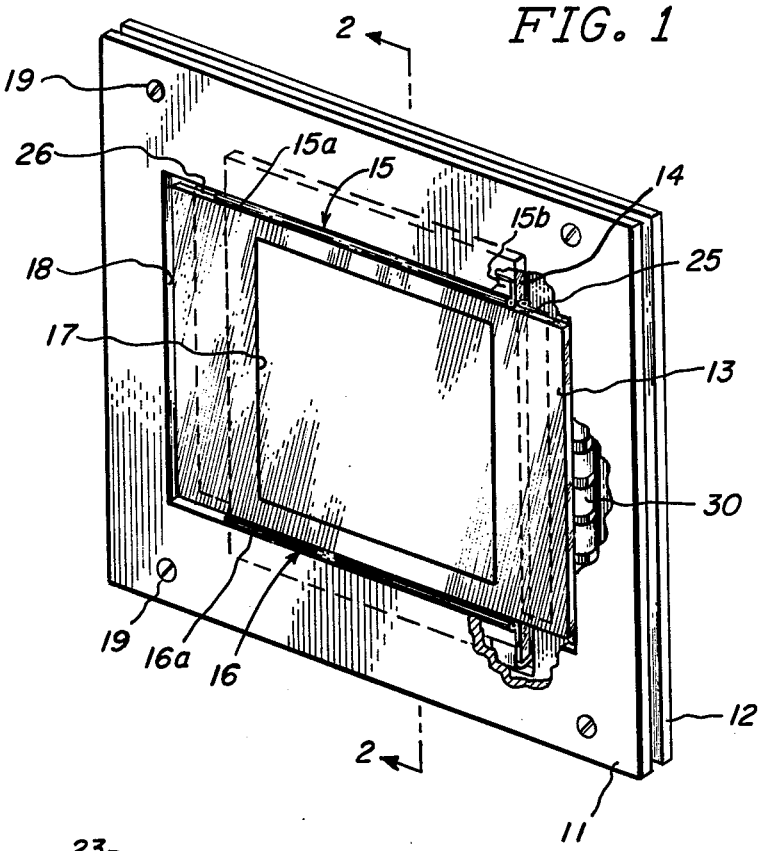
FIG. 3
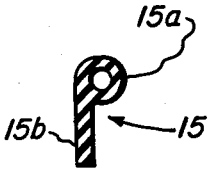
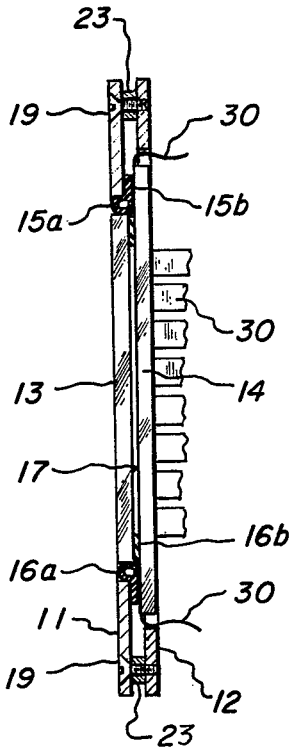
FIG. 2
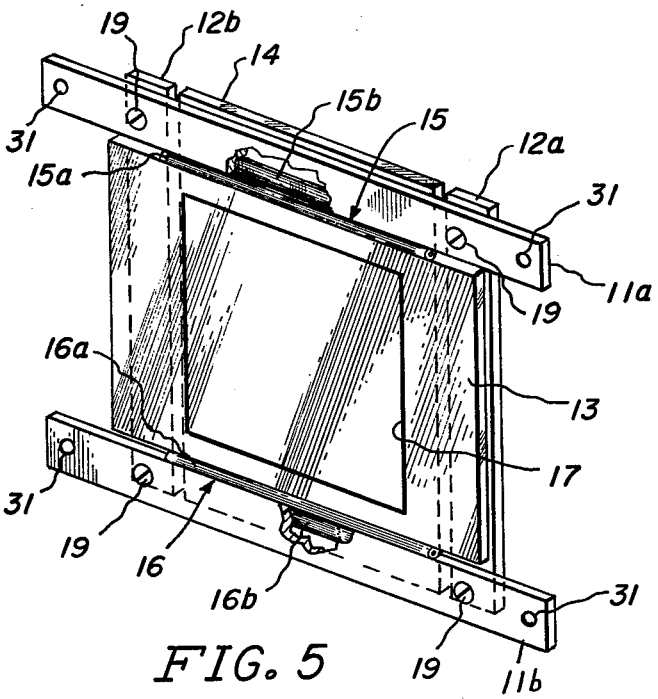
FIG. 5

PLASMA PANEL MOUNTING FRAME

BACKGROUND OF THE INVENTION

1. Field of the Invention

A perennial problem when using the modern electronic computer is the means by which information is exchanged between the computer itself and the human user. Information flow from the computer to a human user, if presented visually, can proceed at a relatively high rate of speed. If permanent records of this information are unnecessary, it is convenient to employ a large area capable of electronically displaying long messages and rapidly altering them. Up to the present time, the usual device employed has been the CRT display terminal.

A further aspect of the common usage involves the fact that ordinary voice grade telephone lines can be used as the communications path between the computer and the terminal, thus creating a demand for a portable terminal. Because of the weight and lack of ruggedness of CRT displays, attention has focused on the so-called plasma display which is substantially more rugged, has approximately the same speed, and at least has the potential to be substantially smaller, lighter and less costly as well for a given size of display area. The lower operating voltages and inherent memory characteristics of the plasma display permits further reduction in the size of the support electronics compared to the CRT display. The instant invention comprises a preferred method of supporting a certain type of plasma display panel now available, and providing for efficient packaging of the support electronics with it. The mechanical support system taught by this invention lends substantial ruggedness to the system with no increase in weight or size as compared to other mechanical mountings now employed.

2. Description of the Prior Art

This panel comprises a pair of flat rectangular glass plates attached face to face with crossed longitudinal axes. A gas-tight seal between the plates defines the display area and forms the attachment. The support structure used previously with this panel compresses the face to face portion of the display panel against the periphery of a window in the trim panel plate or fascia. Clamping forces sufficient to maintain the panel immobile in its support structure during the shock and vibration of normal use are so high that the glass from which the plates are made will often fracture.

BRIEF DESCRIPTION OF THE INVENTION

The ends of both plates forming the plasma panel to which this invention is applicable extend past each other's lateral edges. To support such a crossed plate plasma panel the structure employs resilient tubes or other elongate structures which grip each of the plates forming the plasma panel along its lateral edges so as to absorb shock in the X and Y directions (in the plane of the plates), and resilient pads between each panel plate and the support structure, to provide shock absorbing in the Z direction perpendicular to the plates. Elongate, resilient gasket strips, each having a thickened edge portion and a less thick retaining tab portion form the tubes and pads respectively. One of these gasket strips lies along each lateral edge of both panel plates. The thickened edge of each is adjacent a lateral edge of one plate and the retaining tab portion lies against the projecting face of the other panel plate. A mounting bar lies along each gasket with the thickened edge of the gasket interposed between the bar and the lateral edge of the adjacent panel plate. The retaining tab portion is interposed between the bar and the other panel plate's face. The ends of all four bars are attached to the nearest end of the immediately adjacent mounting bar so as to slightly draw together each pair of bars adjacent opposite lateral edges of a panel plate, slightly compressing the thickened edges of two interposed gaskets. Thus, the panel plates have restricted motion in both the X and Y directions with respect to the bars by deforming these gaskets. In the Z direction, perpendicular to the viewing surface of the panel itself, the resilient retaining tabs compress in absorbing such shocks.

In a preferred embodiment, the cross section of the gaskets have a "P" shape where the rounded hollow portion forms the thickened edge and the leg forms the retaining tab portion. It is convenient to form the two bars on adjacent opposite lateral edges of the same panel plate, from a single flat unitary plate having a cut out center larger in each dimension than the panel plate in it. The bars or support plates can be supported in turn by larger flat plates which can also carry between them the electronic apparatus necessary for operation of the plasma display itself.

Accordingly, one purpose of this invention is to provide a shock resistant mounting for plasma panels of the crossed plate design.

Another purpose is to provide a plasma panel support structure having substantially the inherent thinness of the panel itself.

Another purpose is to provide such a mounting structure which provides for mounting of plasma panel electronics closely adjacent the panel itself, at the same time retaining the desirable thinness inherent in the plasma panel design.

Still another object is to provide an easily assembled and inexpensive plasma panel mounting structure.

Other objects and advantages of this invention are deducible from the description which follows.

BRIEF DESCRIPTION OF THE DRAWINGS

FIG. 1 is a perspective view of a preferred embodiment of this invention.

FIG. 2 is a cross section of the embodiment of FIG. 1.

FIG. 3 is a cross section of the preferred gasket employed in the embodiment of FIG. 1.

FIG. 5 discloses an alternative embodiment of the mounting structure applying the concepts of the structure of FIG. 1.

DESCRIPTION OF THE PREFERRED EMBODIMENTS

Figure 4:
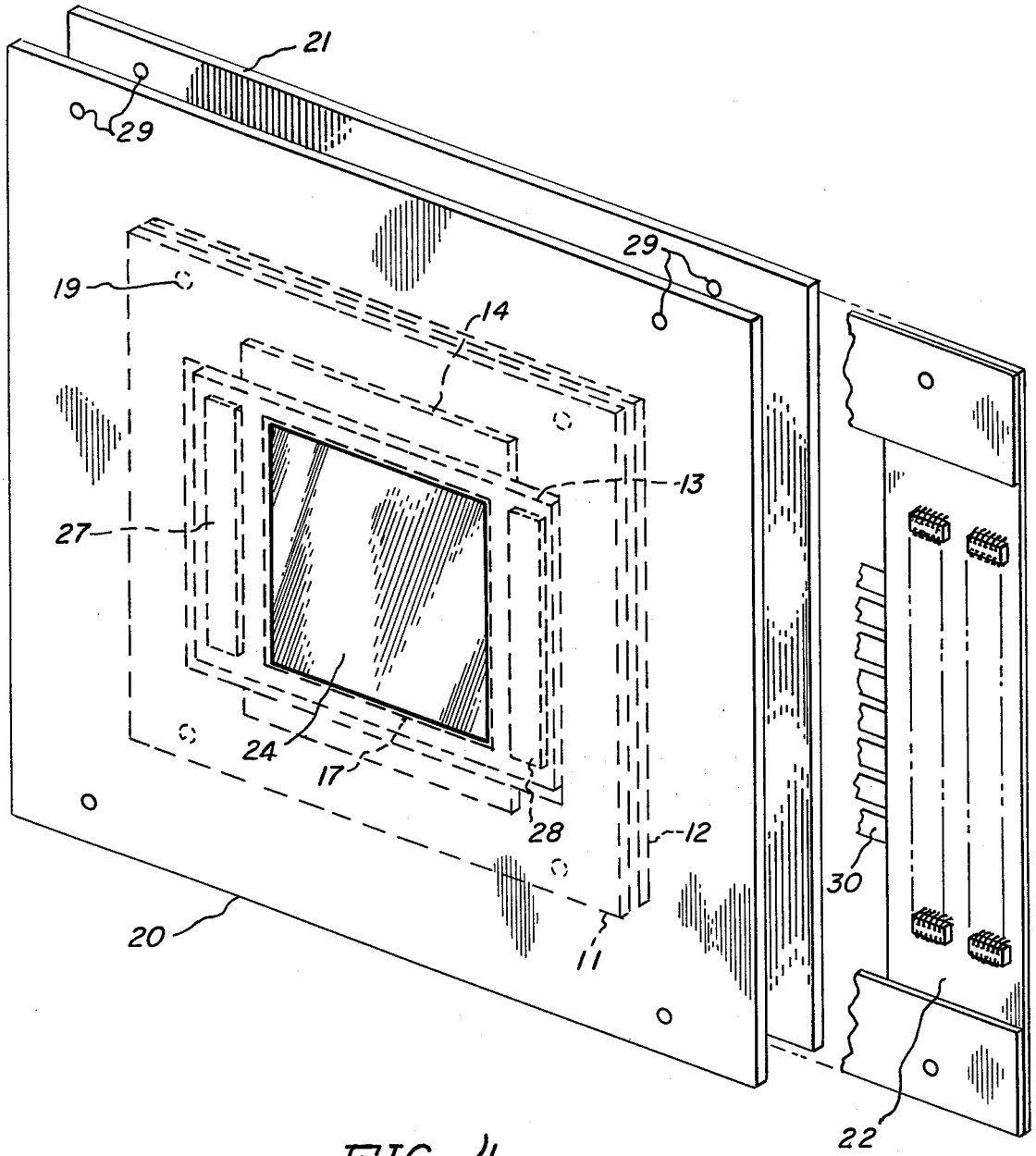
FIG. 4 is a perspective view of a generalized embodiment of a plasma display terminal employing the mounting structure of FIG. 1.

The support structure of FIG. 1 comprises mounting frames 11 and 12 and gaskets 15 and 16. The plasma panel to be supported itself comprises plates 13 and 14 (most clearly shown in FIG. 5) which are flat rectangular glass plates fastened to each other by seal element 17 with major axes at right angles to each other. The lengths of plates 13 and 14 are both greater than the other's widths, and are attached to each other so each end of each plate 13 and 14 extends past a lateral edge of the other. These ends may carry conductors 30 for the plasma panel electrodes within the display or viewing area enclosed by seal 17.

In the support structure of FIG. 1, mounting frame 11 has an opening 18 longer than plate 13 and wider by a small preselected amount than the width of plate 13. Similar comments can be made for a similar opening in mounting frame 12 (not shown). Gaskets 15 and 16 have respectively a thickened edge portion, 15*a* and 16*a*, and a retaining tab portion, 15*b* and 16*b*, respectively. The cross section of a preferred gasket has the "P" shape shown in FIG. 3. Thickened edge portion 15*a* is an approximately hollow cylinder with retaining tab 15*b* attached thereto having an approximately flat rectangular cross section. Each of the gaskets 15 and 16 are formed of some relatively soft and resilient material such as rubber. Gaskets 15 and 16 are positioned such that thickened edge portion 15*a* extends along one lateral edge of plate 13 in contact therewith, and retaining tab portion 15*b* lies flat against plate 14. Similarly, thickened edge portion 16*a* of gasket 16 extends along and in continual contact with the opposite lateral edge of plate 13 with its retaining tab portion 16*b* also lying flat against plate 14. Frame 11 is positioned to cause its opening 18 to totally surround and enclose plate 13 so as to make frame 11 approximately coplanar with plate 13. Two opposite interior edges of opening 18 contact thickened edge portions 15*a* and 16*a* as so positioned adjacent plate 13 with an interference fit which somewhat compresses them between frame 11 and plate 13. This is clearly shown in FIG. 2 which discloses thickened edge portions 15*a* and 16*a* interposed between frame 11 and the lateral edges of plate 13. Retaining tabs 15*b* and 16*b* are interposed between plate 14 and frame 11. Gaskets 25 and 26 are similarly interposed between frame 12 and plates 13 and 14 in exactly the same manner that gaskets 15 and 16 are interposed between these plates and frame 11. Gaskets 25 and 26 preferably have shapes identical to those of gaskets 15 and 16 and function in a fashion identical in every way to that of gaskets 15 and 16. Bolts 19 fasten frame 11 to frame 12 at their respective and facing four corners. Spacers 23 interposed between frames 11 and 12 control their deflection. Excessive pressure against plates 13 and 14 are likely to fracture their projecting ends.

One can see that this mounting provides compressive and resilient opposition to transmission of shock and vibration through frames 11 and 12 to the plasma panel itself. For example, a jolt in the X direction (horizontal in FIG. 1) will cause the thickened edge portion of gasket 25 or 26 to compress somewhat. Furthermore, the friction between frames 11 and 12, gaskets 15 and 16, and plasma plates 13 and 14 result in deformation of thickened edges 15*a* and 16*a*, and restrict slippage between them and plate 13 and/or frame 11.

The structure disclosed in FIG. 1 is designed to form a part of a complete compact plasma display terminal which can function as the human-computer interface. The actual electronic design of such a terminal is outside the scope of this invention. FIG. 4, however, does disclose a packaging arrangement in which the plasma panel can be supported compactly with the drive electronics necessary to produce the desired information displays on it. Mounting element or fascia plate 20 has a window 24 in which the display area of the plasma panel can be seen. Second mounting element 21 conveniently forms the bottom or back of the display terminal, and can have the shape of mounting element 20, although it need not have window 24 in it. Mounting elements 20 and 21 are attached to frames 11 and 12 by bolts 19. Thin rectangular resilient gaskets 27 and 28 are gripped between mounting element 20 and the face of panel plate 13 facing away from panel plate 14, and near the ends of panel plate 13. Similar gaskets are gripped between the ends of panel plate 14 and mounting element 21 in the identical fashion. To prevent excessive pressure between mounting elements 20 and 21 and panel plates 13 and 14 respectively, spacers or standoffs whose heights are slightly less than the uncompressed thickness of gaskets 27 and 28, are fitted on bolts 19 between frame 11 and element 20. Similar gaskets and standoffs are interposed between mounting element 21 and frame 12. Window 24 may be clear, or may include a colored filter to enhance the clarity of the display.

This construction provides a perimeter space between mounting elements 20 and 21, whose width is equal to approximately the combined width of plates 13 and 14, gasket 27 or 28, and the gaskets similar to 27 and 28 adjacent mounting element 21. Circuit board 22 is designed with a width slightly less than the spacing between elements 20 and 21, and so can fit snugly within this area. Conductive leads 27 on plate 13 are easily accessible for connection to circuit board 22. Board 22 can be fastened to the assembly in any convenient fashion, as by bolts through holes 29. Of course, circuit boards can be inserted on all four sides of the peripheral area between elements 20 and 21. It would also be a simple matter to form circuit board 22 as a large rectangular flat plate with a rectangular opening at center to accommodate mounting plates 11 and 12. Connection between the plasma panel and the circuit board in this case must be done before attachment of element 20 to the assembly.

FIG. 5 discloses an alternative embodiment of mounting frames 11 and 12. In this embodiment, mounting frame 11 has been formed of two separate mounting bars, 11*a* and 11*b*. Similarly, mounting frame 12 comprises bars 12*a* and 12*b*. Gaskets 15 and 16 are positioned adjacent panel plate 13 as in FIG. 1. Gaskets 25 and 26 (not shown) are similarly located adjacent plate 14. Bolts 19 fastens these four bars to each other through holes positioned so as to gently compress the attached thickened edge portions 15*a* and 16*a* between them and plate 13, as with the structure of FIG. 1. Similar comments are apposite to the spacing between bars 12*a* and 12*b*. Because the support structure formed by bars 11*a*, 11*b*, 12*a*, and 12*b* is not rigid, it is preferred that rigidity be given it in some convenient fashion. For example, these bars can be bolted to mounting elements similar to mounting elements 20 and 21 through holes 19 and through holes 31. Alternatively, bars 12*a* and 12*b* can be made wide enough to permit each to be bolted to bars 11*a* and 11*b* in two places, say through holes 19 and 31. Because of additional assembly complications inherent in this design, the unitary embodiment of bars 11*a* and 11*b* and bars 12*a* and 12*b* and frames 11 and 12 respectively, as shown in FIG. 1, is preferred.

The preceding describes the invention.

What is claimed is:

1. Apparatus for supporting a plasma display panel of the type formed of first and second flat approximately rectangular plates each longer than the other is wide and firmly attached to each other face to face with each end of each extending past a lateral edge of the other, and comprising:

(a) first through fourth resilient gasket strips each having a thickened edge portion and a less thick retaining tab portion, each of said gaskets' retaining tab portions lying transverse to and touching the face of a panel plate end extending past a lateral edge of the other panel plate, with said gasket's thickened edge extending along and touching a lateral edge of said other panel plate;

(b) first and second mounting frames, each having a pair of interior edges lying adjacent to and extending along a gasket, each edge extending at least to the lateral edges of the panel plate adjacent the adjacent gasket's retaining tab and each said edge so spaced from the other edge in its frame as to cause each edge to compress its adjacent gasket's thickened edge portion; and (c) means for supporting each frame so as to trap the gaskets' retaining tabs between the frames and panel plates.

2. The apparatus of claim 1, wherein the first frame comprises first and second bars defining the sides of an opening therein wide enough to straddle the first panel plate and the gaskets' thickened edge portions adjacent thereto, with an interference fit.

3. The apparatus of claim 1, wherein the first mounting frame comprises a first flat plate having an opening of greater length than the first panel plate's length and whose width is slightly less than the distance between outwardly facing edges of the thickened edge portion of the gaskets in position adjacent the first panel plate's sides, the edges of the opening defining its width forming an interference fit with the gasket's thickened edge portions.

4. The apparatus of claim 3 further comprising:

(a) a fifth resilient flat gasket strip;

(b) a mounting element having a flat surface; and (c) means for attaching the mounting element to the first flat plate with the fifth gasket gripped between the mounting element's flat surface and the surface of the first flat plate facing away from the second mounting frame.

5. The apparatus of claim 4, wherein the first through fourth gaskets have a "P" shaped cross section.

6. The apparatus of claim 4, wherein the means for attaching the first mounting element comprise bolts passing through the facing bar and pressing the bar, gaskets, mounting element, and panel plate end together.

7. The apparatus of claim 5, wherein a portion of the mounting element includes an area with a predetermined optical characteristic covering at least a portion of the face to face areas of the panel plates.

8. The apparatus of claim 7, wherein the predetermined optical characteristic is altered light transmissibility.

9. The apparatus of claim 7, wherein the predetermined optical characteristic is transparency.

10. The apparatus of claim 1, wherein each gasket has a "P" shaped cross section.

11. The apparatus of claim 10, wherein the curved portion of the "P" is hollow.

12. The apparatus of claim 1, further comprising:

(a) first and second mounting elements comprising flat plates, at least one of which has a central window therein, and both having greater length and width than either of the panel plates' length;

(b) fifth through eighth gaskets;

(c) means for attaching the first and second mounting elements to the first and second mounting frames, each of the mounting elements in facing relationship to one face of the plasma display panel, and each mounting element gripping two of the fifth through eighth gaskets between itself and the nearer of the two panel plates with the window framing the face to face portion of the plasma display panel;

(d) a circuit board interposed between the first and second mounting elements adjacent the periphery of the plasma display panel; and (e) means for attaching the circuit board to at least one of the first and second mounting elements.

* * * * *